US009857058B2

(12) United States Patent
Powell

(10) Patent No.: US 9,857,058 B2
(45) Date of Patent: Jan. 2, 2018

(54) TOWER LIGHT SHIELD

(71) Applicant: BCE Inc., Verdun (CA)

(72) Inventor: Mike Powell, Huntsville (CA)

(73) Assignee: BCE Inc., Verdun (CA)

( * ) Notice: Subject to any disclaimer, the term of this patent is extended or adjusted under 35 U.S.C. 154(b) by 0 days.

(21) Appl. No.: 14/926,836

(22) Filed: Oct. 29, 2015

(65) Prior Publication Data

US 2016/0123558 A1 May 5, 2016

Related U.S. Application Data

(60) Provisional application No. 62/072,602, filed on Oct. 30, 2014.

(51) Int. Cl.

| | |
|---|---|
| ***F21S 8/00*** | (2006.01) |
| ***F21V 11/16*** | (2006.01) |
| *F21Y 101/00* | (2016.01) |
| *F21Y 115/10* | (2016.01) |

(52) U.S. Cl.

CPC ..... *F21V 11/16* (2013.01); *F21S 8/00* (2013.01); *F21Y 2101/00* (2013.01); *F21Y 2115/10* (2016.08)

(58) Field of Classification Search

CPC .. F21S 8/00; F21V 11/16; F21V 21/00; F21V 33/0076; B64F 1/18; B64F 1/20

See application file for complete search history.

(56) References Cited

U.S. PATENT DOCUMENTS 2,143,149 A * 1/1939 Guth ..... F21V 11/06 362/354
2,899,543 A * 8/1959 Rasmussen ..... F21V 11/16 362/354

* cited by examiner

*Primary Examiner* — Thomas M Sember
(74) *Attorney, Agent, or Firm* — Gowling WLG (Canada) LLP

(57) ABSTRACT

The present invention relates to a beacon light shield or an obstruction light shield. The beacon or obstruction light shield includes a base for receiving the light fixture, a plurality of ribs mounted on the base, and concentrically rings mounted to the ribs. The concentric rings include an inner ring mounted at a first distance away from the center of the base and an outer ring mounted at a second distance away from the center of the base. The beacon or obstruction light shield masks light from the ground at both distances and at locations close to the tower, and does not interfere with the function of the required lighting for the aircraft.

10 Claims, 4 Drawing Sheets

TOWER LIGHT SHIELD

CROSS-REFERENCE TO RELATED APPLICATIONS

This application claims the benefit of and priority from U.S. Provisional Application No. 62/072,602, filed Oct. 30, 2014, which is hereby incorporated by reference in its entirety.

FIELD OF INVENTION

The present invention relates to a tower light shield or deflector, and more particularly to a tower light shield or deflector for use in connection with beacons or obstruction lights.

BACKGROUND OF THE INVENTION

Federal regulations require that obstructions to aircraft, such as towers and the like be fitted with elements to render them highly visible to approaching aircraft. For this purpose, lighting systems are deployed on structures above a certain height in localities where aircraft are present. A typical lighting system for such a purpose often incorporates a series of lights such as a beacon on top of the structure, and dual obstruction lighting (DOL) and/or single obstruction lighting (SOL) at designated heights, to provide sufficient light to be suitably visible to aircraft.

With the use of such lighting systems, there have been growing concerns of light pollution to observers on the ground within the vicinity of a tower, particularly at night. This issue becomes more problematic as the number of towers increases in residential or cottage areas.

Current solutions known in the field to control nuisance light from tower obstruction lighting includes use of light deflectors or optical stops to block or reduce light in undesired directions. By way of one example, an assembly shield has been provided including a number of frustoconically shaped elements stacked vertically where each frustoconically shaped element is spaced apart from an adjacent element to provide vertical spacing.

Some problems with the conventional tower lighting solutions are that they are prone to collecting snow and ice, and thus impeding the light.

There is therefore a need for an improved tower light shield or deflector.

SUMMARY OF THE INVENTION

According to one embodiment of the present invention, there is provided a beacon light shield comprising a base for receiving a beacon light, a plurality of ribs mounted on the base, and concentric rings mounted to the ribs, wherein the concentric rings include an inner ring mounted at a first distance away from the center of the base and an outer ring mounted at a second distance away from the center of the base.

According to another embodiment of the present invention, there is provided an obstruction light shield comprising a base for receiving an obstruction light, a plurality of ribs mounted on the base, and a plurality of rings mounted to the ribs, wherein the plurality of rings include an inner ring mounted at a first distance away from the center of the base and an outer ring mounted at a second distance away from the center of the base.

BRIEF DESCRIPTION OF THE DRAWINGS

These and other features of the invention will become more apparent from the following description in which reference is made to the appended drawings wherein.

DETAILED DESCRIPTION

Figure 1:
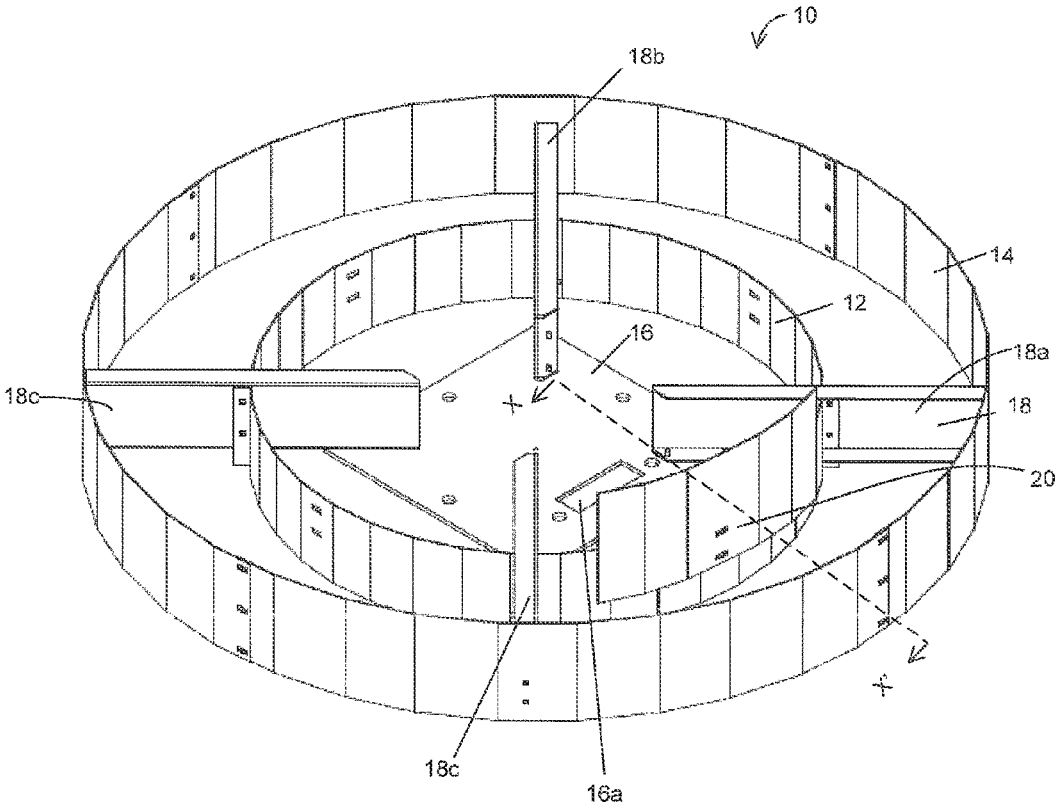
FIG. 1 is a perspective view of the tower light shield in accordance with an embodiment of the present invention.

Referring to the drawings, FIG. 1 shows a tower light shield or deflector (also known as collar) generally designated by reference character 10 according to one embodiment of the invention. The tower light shield 10 comprises a base 16 for receiving a light fixture, e.g., a beacon light, and a plurality of ribs 18 mounted to the base 16. The tower light shield 10 includes a plurality of concentrically arranged rings, in this embodiment including an inner ring 12 and an outer ring 14. The inner ring 12 is mounted at a first distance away from the center of the base 16 and the outer ring 14 is mounted at a second distance away from the center of the base 16. The inner ring 12 is adapted to mask the light for locations close to the tower, and the outer ring 14 is adapted to mask the light for locations at further distances. The tower light shield 10 can be used as a light shield for a beacon light at the top of a tower.

In one embodiment as shown in FIG. 1, the base 16 is arranged at the center of the concentric rings 12, 14, and has an aperture 16*a* and a number of mounting holes for receiving the light fixture. The plurality of ribs 18 are mounted on the base 16, of which four ribs are shown in the illustrated embodiment, which are designated by reference numerals 18*a*, 18*b*, 18*c*, and 18*d*. The ribs 18 are spaced apart from one another and extend radially from the base 16. The ribs 18 include mounting holes for securing the inner ring 12 and the outer ring 14 and may include flanges to increase the rigidity of the structure.

In the illustrated embodiment of FIG. 1, the inner ring 12 and the outer ring 14 may each be constructed by a series of flat metal plates welded or otherwise assembled together, forming a quasi-circular polygon shape. The material and implementation of the inner ring 12 and the outer ring 14 is designed to take into consideration factors such as stiffness, durability against wind, weight, and/or desirable focal point. For tower side mounted beacons, the tower light shield 10 may further include a sleeve 20 at the inner ring 12. The sleeve 20 may project to a different height level compared to the inner ring 12 and the outer ring 14. For tower side applications, the sleeve 20 is adapted to shield or reduce light reflecting off a tower leg. The sleeve may not be necessary for tower top applications. In one embodiment, the sleeve 20 may be a separate piece mounted to the inner ring 12; and in an alternative embodiment, a portion of the inner ring 12 may be widened to form the sleeve 20. In another alternative embodiment, one quarter of the outer ring 14 may be omitted which is shielded by the sleeve 20, which enables the tower light shield 10 to be brought closer to the tower leg.

Figure 2:
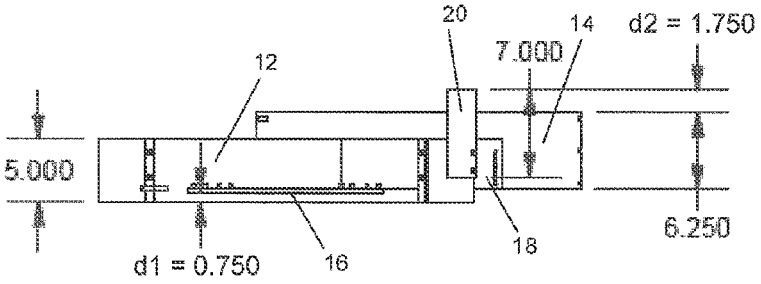
FIG. 2 is a sectional side view of the tower light shield of FIG. 1, taken along X-X'.

FIG. 2 provides a side sectional view of the embodiment as shown in FIG. 1. In accordance with an exemplary embodiment, the inner ring 12 may have a diameter of about 2.6 inches and a height of about 5 inches; and the outer ring 14 may have a diameter of about 4 inches and a height of about 6.25 inches. The sleeve 20 for tower side applications may be mounted between two adjacent ribs 17 and may expand less than one fourth of the inner ring 12. The sleeve 20 may have a height of about 7 inches.

As best shown with reference to FIG. 2, each of the inner ring 12, the outer ring 14, and the sleeve 20 have a respective lower peripheral edge that defines a bottom horizontal plane and a respective upper peripheral edge that defines a top horizontal plane. The top horizontal plane of the inner ring 12 may be arranged to be lower than the top horizontal plane of the outer ring 14, as the inner ring 12 and the outer ring 14 are to shield light of different distances. In accordance with the exemplary embodiment, the top horizontal plane of the inner ring 12 may be arranged to be lower than the top horizontal plane of the outer ring 14 by a spacing of about 2 inches.

The bottom horizontal planes of the base 16 and the outer ring 14 may further be arranged to substantially coincide with each other, and higher than the bottom horizontal plane of the inner ring 12. In accordance with one exemplary embodiment, the bottom horizontal plane of the inner ring 12 may be lower than the base 16 by a spacing d1 of about 0.75 inch. The sleeve 20 may be mounted at a higher level compared to the outer ring 14 and the inner ring 12. For example, the top horizontal plane of the sleeve 20 may be higher than the top horizontal plane of the outer ring 14 by a spacing d2 of about 1.750 inches.

The heights and the spacing between the light fixture, the inner ring 12 and the outer 14 create a tiered structure effective in shielding light at different distances. While specific dimensions and configurations are given in the embodiment, it will be apparent to a person skilled in the art that other dimensions and configurations of the inner ring 12 and the outer ring 14 are possible, for example, depending on the manufacturer, height and configuration of the light fixture to be used as well as the distances from the tower that light is to be shielded toward the ground. Accordingly, the shapes and/or widths of the inner ring 12 and the outer ring 14 and their relative positions or relative heights are customizable depending on different applications. As well, while two rings 12 and 14 are used in this embodiment, more than two rings may be used to implement the tower light shield.

Figure 3:
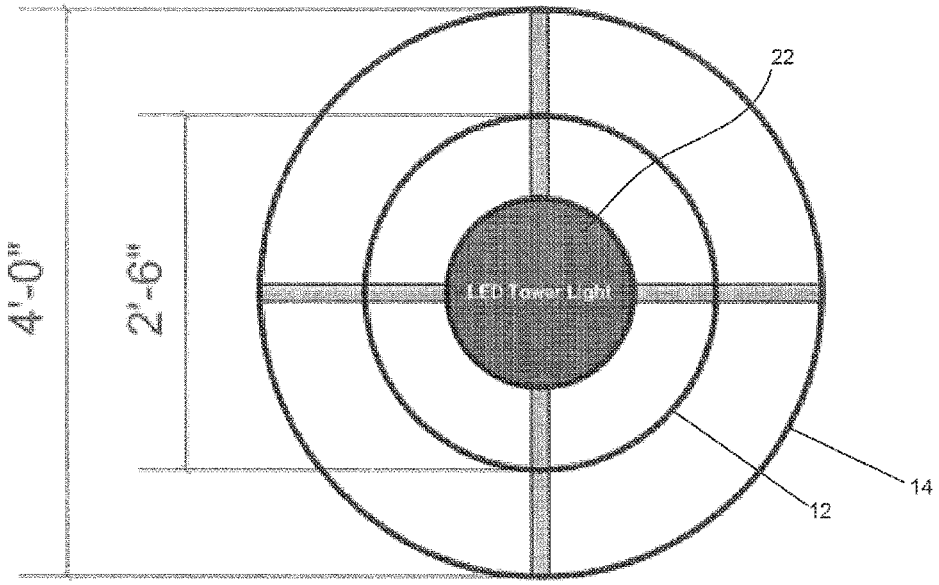
FIG. 3 is a top view of the tower light shield in accordance with an embodiment of the present invention, with an LED tower light installed in the center.
Figure 4:
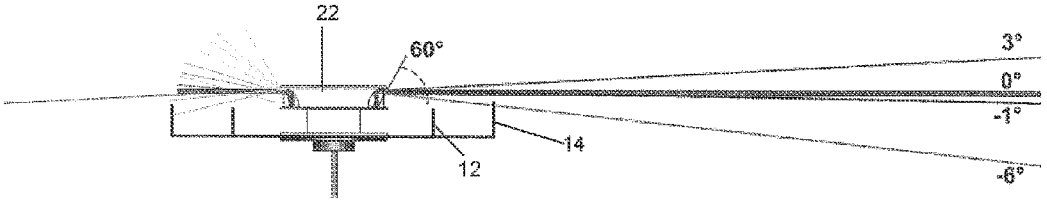
FIG. 4 is a side elevation view of the tower light shield and the LED tower light of FIG. 3.

FIG. 3 provides a top view of the tower light shield 10, with an LED tower light 22 installed in the center, in accordance with an embodiment of the invention. As shown in FIG. 4, the top horizontal plane of the LED tower light 22 is projected at a higher level than the horizontal plane of the outer ring 14 to ensure that the tower light shield 10 does not interfere with the function of the lighting required at the horizon. Moreover, within the coverage of a 360 azimuth around the tower, the tower light shield 10 masks the LED tower light 22 below the horizon at distances and blocks the light from ground view at locations close to the tower. The tower light shield or deflector 10 according to the embodiment shields light toward the ground, but at the same time is able to comply with regulations and rules applicable for lighting required for aircraft.

While the tower light shield 10 as illustrated in FIG. 1 can be used for beacon lights at the top of the tower, similar design can be adapted for use of obstruction lights, for example, for use of dual obstruction lighting (DOL) and/or single obstruction lighting (SOL). The DOL and SOL are typically lights employed midway at the tower or at the top of a tower that is below a certain height.

Figure 5:
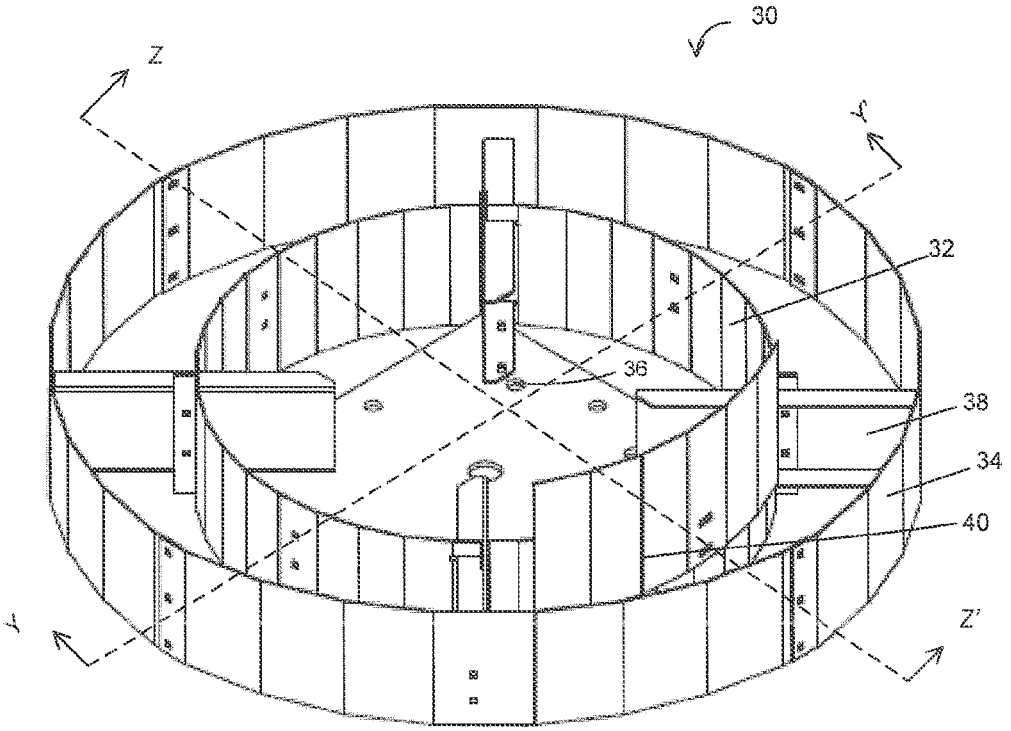
FIG. 5 is a perspective view of the tower light shield in accordance with another embodiment of the present invention.
Figure 6:
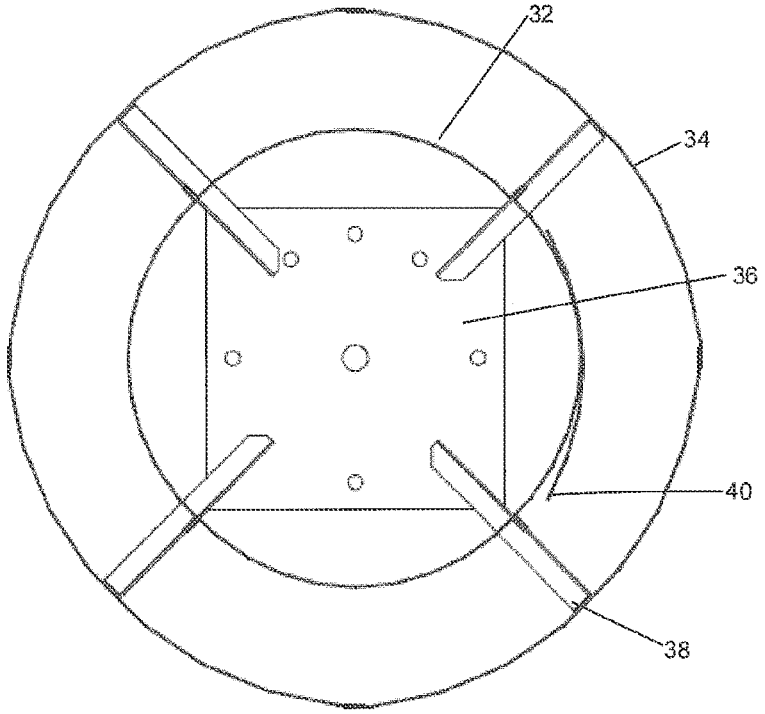
FIG. 6 is a top view of the tower light shield of FIG. 5.
Figure 7:
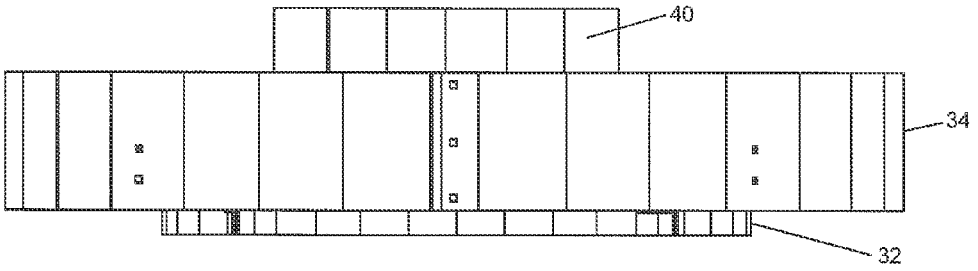
FIG. 7 is a side elevation view of the tower light shield of FIG. 5, taken along Y-Y'.
Figure 8:
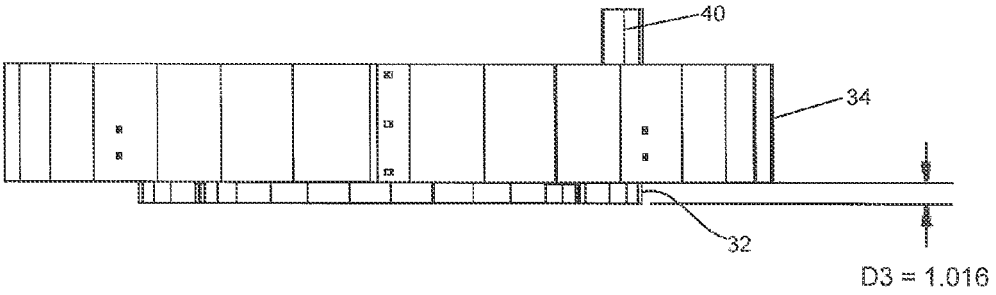
FIG. 8 is a side elevation view of the tower light shield of FIG. 5, taken along Z-Z'.

FIG. 5 illustrates a modified tower light shield generally designated by reference character 30 according to another embodiment of the invention. The tower light shield 30 is implemented for use of DOL and/or SOL. The configuration of the tower light shield 30 is substantially the same as the tower light shield 10 as shown in FIG. 1, with the exception that the tower light shield 30 has a plurality of rings 32, 34 with smaller diameters. For example, in the illustrated example, the diameter of the outer ring 34 of the tower light shield 30 is 24 inches and the diameter of the inner ring 32 is 18 inches. Similar to the tower light shield 10, the bottom horizontal plane of the outer ring 34 may be arranged to be higher than the bottom horizontal plane of the inner ring 32 by a spacing d3. For tower side mounted obstruction lighting, the tower light shield 30 may also include a sleeve at the inner ring 32. The sleeve may project to a different height level compared to the inner ring 32 and the outer ring 34. The sleeve may not be necessary for tower top applications. In an alternative embodiment, one quarter of the outer ring 34 may be omitted which is shielded by the sleeve, which enables the tower light shield 30 to be brought closer to the tower leg.

While specific dimensions and configurations are given in the embodiment, it will be apparent to a person skilled in the art that other dimensions and configurations of the inner ring 32 and the outer ring 34 are possible, for example, depending on the manufacturer, height and configuration of the light fixture to be used as well as the distances from the tower that light is to be shielded toward the ground. Accordingly, the shapes and/or widths of the inner ring 32 and the outer ring 34 and their relative positions or relative heights are customizable depending on the applications. For example, while the tower light shield 30 employs a round shape for the rings 32, 34, it will be understood to a person skilled in the art that other shapes, for example, an oval shield, may be used for the obstruction lights. As well, while two rings 32 and 34 are used in this embodiment, more than two rings may be used to implement the tower light shield.

One or more currently preferred embodiments have been described by way of example. It will be apparent to persons skilled in the art that a number of variations and modifications can be made without departing from the scope of the invention as defined in the claims.

All citations are hereby incorporated by reference.

What is claimed is:

1. A tower light shield comprising:

a base for receiving a tower light, a plurality of ribs mounted on the base each extending horizontally from the base, and concentric rings mounted to the ribs, wherein the concentric rings include an inner ring mounted at a first distance away from the center of the base and an outer ring mounted at a second distance away from the center of the base, where the inner ring and the outer ring each have a respective upper peripheral edge that defines a respective top horizontal plane, the top horizontal plane of the inner ring being arranged to be lower than the top horizontal plane of the outer ring.

2. The tower light shield according to claim 1, wherein the tower light is a beacon.

3. The tower light shield according to claim 1, wherein the tower light is an obstruction light.

4. The tower light shield according to claim 3, wherein the obstruction light is dual obstruction lighting (DOL).

5. The tower light shield according to claim 3, wherein the obstruction light is single obstruction lighting (SOL).

6. The tower light shield according to claim 1, wherein the inner ring includes a sleeve for shielding light reflecting off a tower leg.

7. The tower light shield according to claim 6, wherein the sleeve has an upper peripheral edge that defines a top horizontal plane which is higher than the top horizontal plane of the inner ring.

8. The tower light shield according to claim 6, wherein the sleeve is mounted to the inner ring.

9. The tower light shield according to claim 6, wherein a portion of the inner ring is widened to form the sleeve.

10. The tower light shield according to claim 1, wherein the concentric rings are of a quasi-circular polygon shape.

* * * * *